US006083116A

United States Patent [19]

Loredo

[11] Patent Number: 6,083,116

[45] Date of Patent: Jul. 4, 2000

[54] GOLF CLUB WEIGHT TRAINING SYSTEM

[75] Inventor: Thomas C. Loredo, Roselle Park, N.J.

[73] Assignee: D.B. Consolidated Enterprises, Inc., Roselle Park, N.J.

[21] Appl. No.: 09/309,812

[22] Filed: May 11, 1999

Related U.S. Application Data

[60] Provisional application No. 60/085,402, May 13, 1998.

[51] Int. Cl.[7] ..... A63B 69/36

[52] U.S. Cl. ..... 473/256

[58] Field of Search ..... 473/219, 226, 473/256, 282, 297

[56] References Cited

U.S. PATENT DOCUMENTS

| | | | |
|---|---|---|---|
| 3,716,239 | 2/1973 | Goudreau . | |
| 4,045,034 | 8/1977 | Thomas . | |
| 4,588,191 | 5/1986 | Stewart . | |
| 5,527,039 | 6/1996 | Levesque | 473/256 X |
| 5,769,734 | 6/1998 | Qualey, Sr. | 473/233 |
| 5,776,006 | 7/1998 | Gruber | 473/256 |

*Primary Examiner*—John A. Ricci

*Attorney, Agent, or Firm*—Lerner, David, Littenberg, Krumholz & Mentlik, LLP

[57] ABSTRACT

The present invention relates to a golf club weight system for use as a training or stretching device in which the weight system is adapted for easy attachment and detachment to a golf club shaft, and permits precise weight adjustments to be made to the device to meet the individual needs of a particular golfer. The golf club weight system consists of a housing containing a first section and a second section, the first section and second section having a general planar surface and corresponding channels extending axially from top to bottom of the device. The channel of the first section aligns with the channel of the second section to form a bore for receiving a portion of the golf club shaft. The housing further contains a plurality of openings for receiving removable weights. The openings consist of internal bores that are located within the sections of the housing.

12 Claims, 3 Drawing Sheets

GOLF CLUB WEIGHT TRAINING SYSTEM

BACKGROUND OF THE INVENTION

The present application claims the benefit of U.S. Provisional Application Serial No. 60/085,402 filed on May 13, 1998.

1. Field of the Invention

The present invention relates to golf club weight training device for attachment to the shaft of a golf club.

2. Description of Prior Art

Removable golf club weight training devices are known in the art. Certain ones are designed to assist golfers when warming-up as well as to correct minor incoordinations in the golfer's swing. For example, Goudreau, U.S. Pat. No. 3,715,239, discloses a golf club weight in the shape of a donut. The weight has an axial passage that permits the weight to be placed around the shaft of a golf club. Thomas, U.S. Pat. No. 4.045,034, discloses a golf club weight device formed of a flexible sheet material which is wrapped around the shaft of a golf club. The weights are placed in pockets that are attached into the flexible sheet material of the device. Stewart, U.S. Pat. No. 4,588,191, discloses a self-clamping golf club that has two sections with a groove for receiving the shaft of a golf club. The two sections are clamped around the shaft of a golf club.

Other removable golf club weight training devices are also known. For example, Qualey, Sr., U.S. Pat. No. 5,769,734, discloses a golf swing training device having a bell-shaped weight device that is slideably mountable to the shaft of a golf club. Lee, U.S. Pat. No. 4,809,631, discloses a shaft having a golf grip attached at an upper end and stop formed at a lower end, in which the weight is slideably mounted on the shaft, and a coil spring is mounted between the weight and the stop.

SUMMARY OF THE INVENTION

The present invention relates to a golf club weight training system for use as a training device to improve a person's golf swing. The present invention may also be used as a stretching device for use by a golfer when warming up. More particularly, the present invention relates to a golf club weight system adapted for easy attachment and detachment to a golf club shaft that permits precise weight adjustments to be made to the device to meet the individual needs of a particular golfer.

The golf club weight system of the present invention includes a housing containing a first section and a second section. The first section and second section have a generally planar surface and corresponding channels extending axially from top to bottom of the device. The channel of the first section aligns with the channel of said second section to from a bore for receiving a portion of the golf club shaft. The housing further contains a plurality of openings for receiving removable weights. The openings consist of internal bores located in the sections of the housing. A fastener is used to secure the casing around the shaft of a golf club.

DESCRIPTION OF THE PREFERRED EMBODIMENTS

As shown in FIGS. 1–6, this invention is directed to a removable golf club weight training device (9) that easily attaches and detaches to the shaft (16) of the golf club (10) (see FIG. 6) and permits weight adjustments to be made to the device (9).

Figure 1:
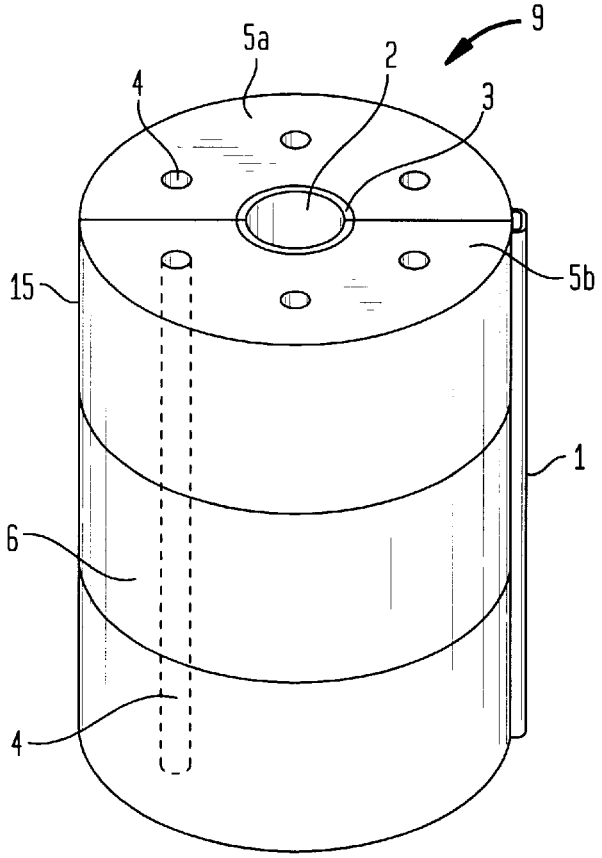
FIG. 1 is a perspective view of a golf club weight system training system in accordance with one embodiment of the present invention.

As shown in FIG. 1, the device (9) is composed of a housing (15) having a plurality of openings (4) for receiving removable weights. The housing may be made of any suitable material, including, for example, plastic, metal, or wood. The housing preferably comprises a split cylinder having two sections (5*a* and 5*b*). Preferably, the sections (5*a* and 5*b*) are hemispherical.

Figure 2:
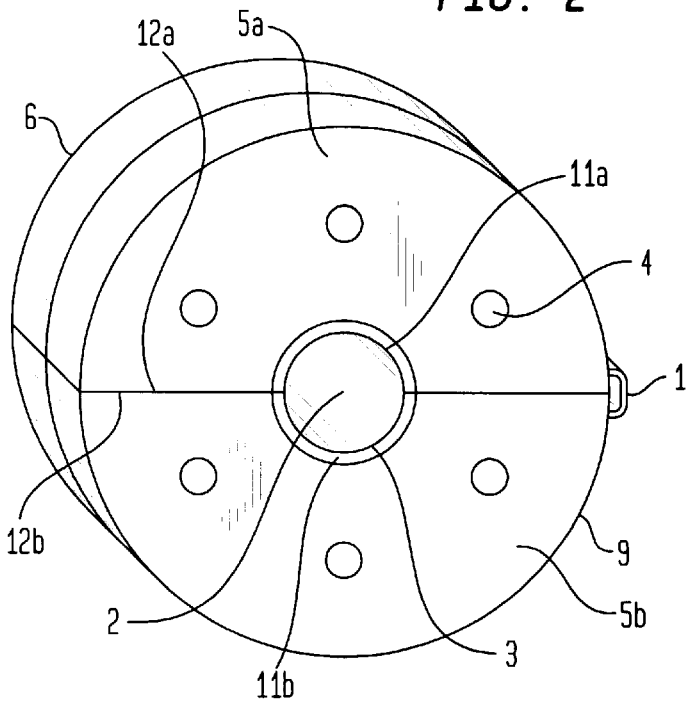
FIG. 2 is a top plan view of the golf club weight training system of FIG. 1 in the closed position.

The sections (5*a* and 5*b*) of the device have generally planar surface (12*a* and 12*b*) which may abut each other and complementary channels (11*a* and 11*b*) that may extend axially from top to bottom of the housing. As shown in FIG. 2, the channels (11 and 11*b*) are arranged in operation to form a bore (2) when the device is in the closed position. The bore has a diameter slightly larger than at least one section of the shaft (16) of a golf club (10) and encloses the shaft of a golf club (10). Preferably the bore is formed in a central portion of the device. In a preferred embodiment, the diameter of the bore is about $\frac{3}{8}^{th}$ of an inch. However, the bore can be constructed so as to fit any sized golf club shaft or any portion of the golf club shaft.

The channels (11*a* and 11*b*) which form the bore may contain a material and/or a coating (3) to substantially increase the coefficient of friction of the bore opening and prevents the movement of the device along the shaft of the golf club. In a preferred embodiment, each channel 11*a* and 11*b* contains a rubber lining. In another preferred embodiment, each channel is coated with a material, such as a silicone elastomeric coating, to increase the coefficient of friction. In yet another preferred embodiment, the rubber lining is coated with a material to further prevent movement of the device along the shaft (16) of the golf club (10).

The sections (5*a* and 5*b*) may be connected using any suitable connection (1), including, for example, a hinge or a clamp. Preferably, the sections are connected by a hinge. More preferably, the hinge may be located within the device.

The device (9) closes securely around the shaft of a golf club using a fastener (6). In a preferred embodiment, the fastener is a strip of hook-and-loop fastener such as Velcro®. In another preferred embodiment, the device is secured around the shaft using a latch fastener. In yet another preferred embodiment, the device is secured around the shaft using an elastic fastener. In yet another preferred embodiment, the device is secured around the shaft of the club using a clamp. In accordance with the present invention, the fastener (6) may also be used as the connection (1) of the device.

An important aspect of the present invention is the ability to readily adjust the weight of the device to meet the needs of a particular golfer by easily and readily adding or subtracting weights from the system. Weight adjustments may be made to account for the variables and needs of a particular golfer, including, for example, the golfer's weight, height, strength and skill. The weight adjustments may also be based on whether the device is being used as a stretching device or to correct minor incoordinations in the golfer's swing.

Figure 3:
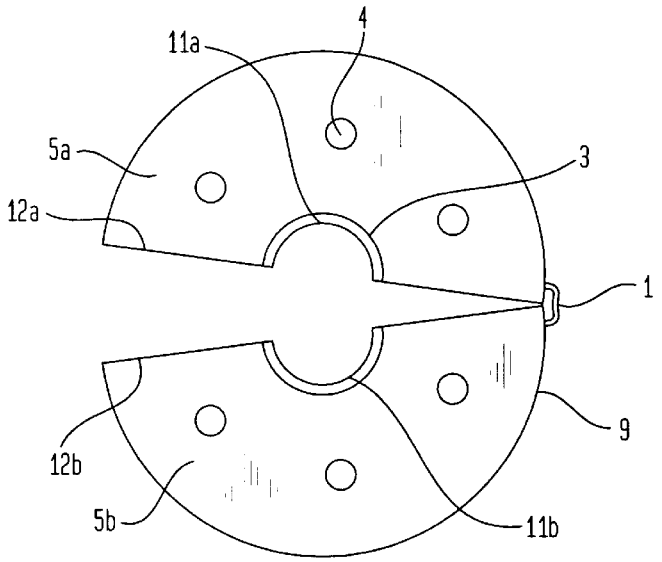
FIG. 3 is a top plan view of the golf club weight training system of FIG. 1 in the open position.

The weights (7) may be easily positioned and removably replaced in the openings (4) in the device (9). As best shown in FIGS. 1–3, each section (5*a* and 5*b*) of the device houses a plurality of openings (4) for receiving the removable weights (7). The openings may be any shape or size that corresponds to the weights (7). Preferably, the openings are spaced to provide appropriate balance when weights are added to the device. In another embodiment, the two sections (5*a* and 5*b*) of the device house a plurality of pockets located on the surface the sections. The pockets receive the weights and can be closed to prevent the weights from dislodging during use.

Figure 4A:
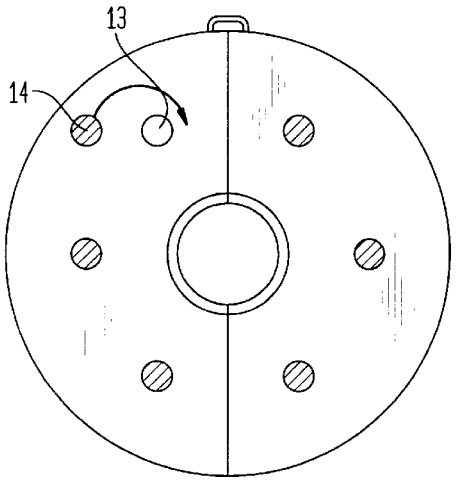
FIGS. 4*a,* 4*b* and 4*c* are top plan schematic drawings illustrating the weight attachments in the golf club weight training system.
Figure 4B:
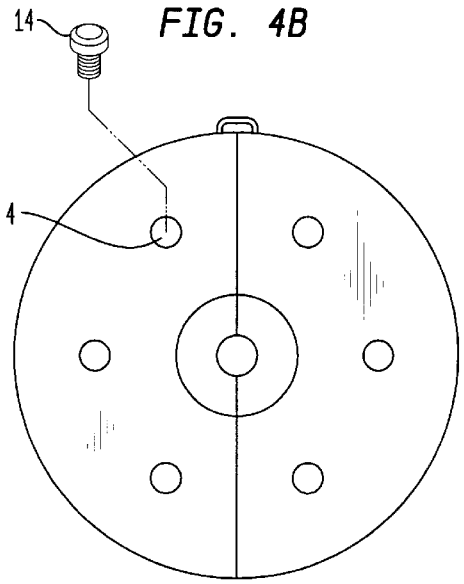
Figure 4C:
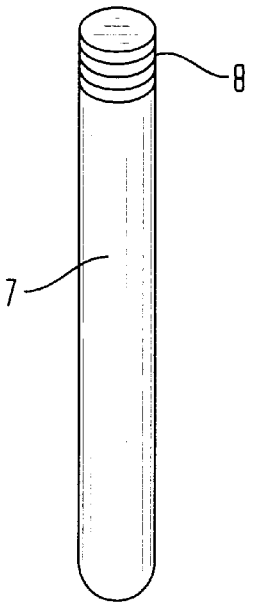
Figure 5:
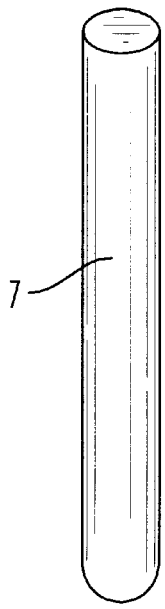
FIG. 5 is a perspective view of a weight.
Figure 6:
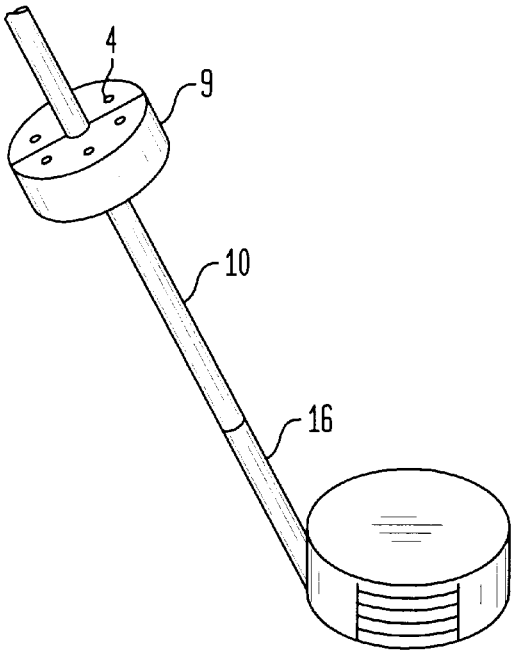
FIG. 6 is an illustration of the attachment of the weight training system to the shaft of a golf club.

As shown in FIG. 4*b,* the weights may be secured in the openings using a cap, which prevents the weights from dislodging during use. A threaded portion of the cap mates with a portion of the openings (4). As shown in FIG. 4*a,* in another preferred embodiment, the weights are held in place using slideable caps (13) that are attached to the device adjacent the openings and which can slide to cover the openings (4). The weights may also be pressure-fitted to prevent their dislodgment from the openings. As shown in FIG. 4*c*, in yet another embodiment, the weights (7) may contain a threaded section (8) which mates with a portion of the openings (4) and prevents their dislodgment from the openings during use.

In accordance with this embodiment of the present invention, the weights and/or weight housing may be numbered or colored to instruct the golfer as to the appropriate amount of weight to be added to the system, depending on the needs of the golfer. The weights an/or weight housing may also be numbered or colored to ensure the proper placement and arrangement of the weights in the system, for example, to insure the proper balance of the device during use.

The weights may be of any size or shape. Preferably the weights vary in weight amount to provide a variety weight options to the golfer. The weight amounts preferably range from 0.05 oz to 10 oz. The weights may be made of a variety of materials, including, for example, lead, silver, copper, brass, composite material and the like.

The size and shape of the device can also vary. In a most preferred embodiment, the length is about 3 inches to about 4 inches and the diameter is about 2 inches.

What is claimed is:

1. A golf club weight training system for attachment to the shaft of a golf club comprising:

a housing;

said housing further comprising a first section and a second section; said first section and said second section each having at least a generally planar surface and a channel extending axially therethrough from the top to the bottom of the housing; wherein said channel of said first section aligns with said channel of said second section to form a bore for receiving a portion of the golf club shaft;

a plurality of openings for receiving easily replaceable and removable weights; wherein said openings are arranged within said first section and said second section of said housing; said openings having at least one open end for receiving removable weights; and a fastener for securing said housing around the shaft of the golf club.

2. The golf club weight training system of claim 1, further comprising a connection that connects said first section to said second section.

3. The golf club weight training system of claim 2, wherein said connection is a hinge.

4. The golf club weight training system of claim 1, wherein said fastener is a hook-and-loop fastener strap.

5. The golf club weight training system of claim 1, further comprising a plurality of slideable caps attached to said casing adjacent said plurality of openings.

6. The golf club weight training system of claim 1, further comprising a plurality of weights for insertion into said plurality of openings.

7. The golf club weight training system of claim 6, wherein said plurality of weights are pressure-fitted to secure said plurality of weights in said plurality of openings during use.

8. The golf club weight training system of claim 6, further comprising a plurality of caps to secure said plurality of weights in said openings.

9. The golf club weight training system of claim 1, wherein said channels include a rubber lining.

10. The golf club weight training system of claim 1, wherein said channels include a silicone elastomeric coating.

11. A golf club weight training system for attachment to the shaft of a golf club for use as a stretching device and training device comprising:

a housing;

said housing further comprises a first section and a second section; said first section and said second section each having a generally planar surface and a channel extending axially from top to bottom of the housing; wherein said channel of said first section aligns with said channel of said second section to form a bore for receiving a portion of the golf club shaft;

a plurality of pockets for receiving easily replaceable and removable weights; wherein said pockets are disposed on said first section and said second section of said housing; said pockets having open ends for receiving removable weights; and a fastener to secure said housing around the shaft of the golf club.

12. A golf club weight training system for attachment to the shaft of a golf club comprising:

a housing;

said housing further comprising a first section and a second section; said first section and said second section each having a generally planar surface and a channel extending axially from top to bottom of the housing; wherein said channel of said first section aligns with said channel of said second section to form a bore for receiving a portion of the golf club shaft;

a plurality of openings for receiving easily replaceable and removable weights; wherein openings are arranged within said first section and said second section of said housing; said openings having open ends for receiving removable weights;

a fastener to secure said housing around the shaft of the golf club; and a plurality of weights for insertion into said plurality of openings.

* * * * *